US011259125B2

(12) United States Patent
Lee et al.

(10) Patent No.: US 11,259,125 B2
(45) Date of Patent: Feb. 22, 2022

(54) MEMS MICROPHONE AND METHOD OF MANUFACTURING THE SAME

(71) Applicant: DB HITEK CO., LTD., Seoul (KR)

(72) Inventors: Han Choon Lee, Seoul (KR); Hyeok In Kwon, Gyeonggi-do (KR); Jong Won Sun, Gyeonggi-do (KR); Dong Chun Park, Incheon (KR); Ye Eun Na, Seoul (KR)

(73) Assignee: DB HITEK CO., LTD., Seoul (KR)

( * ) Notice: Subject to any disclaimer, the term of this patent is extended or adjusted under 35 U.S.C. 154(b) by 17 days.

(21) Appl. No.: 16/842,303

(22) Filed: Apr. 7, 2020

(65) Prior Publication Data

US 2020/0322732 A1 Oct. 8, 2020

(30) Foreign Application Priority Data

Apr. 8, 2019 (KR) ..... 10-2019-0040565

(51) Int. Cl.
*H04R 19/04* (2006.01)
*H04R 31/00* (2006.01)

(52) U.S. Cl.
CPC ..... *H04R 19/04* (2013.01); *H04R 31/00* (2013.01); *H04R 2410/03* (2013.01)

(58) Field of Classification Search
CPC . H04R 19/00; H04R 19/005; H04R 2201/003
See application file for complete search history.

(56) References Cited

U.S. PATENT DOCUMENTS 8,590,136 B2 * 11/2013 Yang ..... H04R 19/005 29/594
9,382,109 B2 * 7/2016 Johansen ..... H04R 31/00
9,630,837 B1 * 4/2017 Chu ..... B81B 3/0021
9,888,324 B2 * 2/2018 Hu ..... H04R 7/20
9,967,679 B2 * 5/2018 Krumbein ..... B81B 7/02
9,980,052 B2 * 5/2018 Johansen ..... H04R 19/005
10,065,852 B2 * 9/2018 Cheng ..... H04R 19/04
10,250,998 B2 * 4/2019 Hsieh ..... H04R 31/003
(Continued)

FOREIGN PATENT DOCUMENTS

CN 103281659 A * 9/2013

*Primary Examiner* — Ryan Robinson
(74) *Attorney, Agent, or Firm* — Patterson Thuente Pedersen, P.A.

(57) ABSTRACT

A MEMS microphone includes a substrate presenting a vibration area, a supporting area surrounding the vibration area and a peripheral area surrounding the supporting area, the substrate defining a cavity formed in the vibration area, a lower back plate being disposed over the substrate to cover the cavity and having a plurality of lower acoustic holes, a diaphragm being disposed over the lower back plate, the diaphragm being spaced apart from the lower back plate and configured to generate a displacement thereof in response to an applied acoustic pressure, an upper back plate being disposed over the diaphragm, the upper back plate being spaced apart from the diaphragm and having a plurality of upper acoustic holes, and an intermediate anchor being in contact with an upper surface of the lower back plate in the supporting area, the intermediate anchor being configured to support the diaphragm to space the diaphragm from the lower back plate, and to provide elasticity for the diaphragm.

19 Claims, 8 Drawing Sheets

(56) References Cited

U.S. PATENT DOCUMENTS

| | | | | |
|---|---|---|---|---|
| 10,405,099 | B2 * | 9/2019 | Jost | B81B 7/0006 |
| 10,419,858 | B2 * | 9/2019 | Ravnkilde | B81B 3/0072 |
| 10,506,345 | B2 * | 12/2019 | Klein | H04R 23/00 |
| 10,589,987 | B2 * | 3/2020 | Wiesbauer | H04R 1/406 |
| 10,766,763 | B2 * | 9/2020 | Lin | B81B 3/0021 |
| 10,981,780 | B2 * | 4/2021 | Klein | B81B 3/0021 |
| 10,993,043 | B2 * | 4/2021 | Lee | H04R 1/406 |
| 2015/0264462 | A1 * | 9/2015 | Okugawa | H04R 19/04 381/174 |
| 2015/0289046 | A1 * | 10/2015 | Dehe | H04R 1/08 381/111 |
| 2017/0156008 | A1 * | 6/2017 | Rasmussen | H04R 31/006 |
| 2020/0290864 | A1 * | 9/2020 | Fueldner | H04R 23/00 |

* cited by examiner

MEMS MICROPHONE AND METHOD OF MANUFACTURING THE SAME

CROSS-REFERENCE TO RELATED APPLICATION

This application claims priority to Korean Patent Application No. 10-2019-0040565, filed on Apr. 8, 2019, and all the benefits accruing therefrom under 35 U.S.C. § 119, the contents of which are incorporated by reference in their entirety.

TECHNICAL FIELD

The present disclosure relates to Micro-Electro-Mechanical Systems (MEMS) microphones capable of converting an acoustic wave into an electrical signal, and a method of manufacturing such MEMS microphones, and more particularly, to capacitive MEMS microphones that are capable of transmitting signals related to an acoustic signal using a displacement which may be generated due to an acoustic pressure and a method of manufacturing such MEMS microphones.

BACKGROUND

Generally, a capacitive microphone utilizes a capacitance between a pair of electrodes which are facing each other to generate an electrical signal indicative of an incoming acoustic wave. A MEMS microphone may be manufactured by a semiconductor MEMS process.

In order to apply the MEMS microphone to a mobile device such as a mobile phone, the signal-to-noise ratio (SNR) of the MEMS microphone must be improved.

In order to improve the SNR of the MEMS microphone, the MEMS microphone may include a bendable diaphragm and double back plates which are facing the diaphragm.

However, each of the diaphragm, the back plates, and insulation layers supporting the diaphragm and the back plates has a flat plate shape. Therefore, a flexibility of the diaphragm may be poor, and the sensitivity and the SNR of the MEMS microphone can be relatively low.

SUMMARY

The embodiments of the present invention provide a MEMS microphone capable of improving a sensitivity and a SNR of the MEMS microphone, and a method of manufacturing the MEMS microphone.

According to an example embodiment of the present invention, a MEMS microphone includes a substrate presenting a vibration area, a supporting area surrounding the vibration area and a peripheral area surrounding the supporting area, the substrate defining a cavity formed in the vibration area, a lower back plate being disposed over the substrate to cover the cavity and having a plurality of lower acoustic holes, a diaphragm being disposed over the lower back plate, the diaphragm being spaced apart from the lower back plate and configured to generate a displacement thereof in response to an applied acoustic pressure, an upper back plate being disposed over the diaphragm, the upper back plate being spaced apart from the diaphragm and having a plurality of upper acoustic holes, and an intermediate anchor being in contact with an upper surface of the lower back plate in the supporting area, the intermediate anchor being configured to support the diaphragm to space the diaphragm from the lower back plate, and to provide elasticity for the diaphragm.

In an example embodiment, the MEMS microphone may further include a lower anchor being in contact with an upper surface of the substrate in the supporting area, the lower anchor being configured to support the lower back plate to space the lower back plate from the substrate, and an upper anchor being in contact with an upper surface of the diaphragm in the supporting area, the upper anchor being configured to support the upper back plate to space the upper back plate from the diaphragm, In an example embodiment, the MEMS microphone may further include a lower insulation layer disposed on the upper surface of the substrate and outside of the lower anchor, and being configured to support the lower back plate, an intermediate insulation layer disposed on an upper surface of the lower insulation layer and outside of the intermediate anchor, and being configured to support the diaphragm, and a upper insulation layer disposed on an upper surface of the intermediate insulation layer and outside of the upper anchor, and being configured to support the upper back plate.

In an example embodiment, the MEMS microphone may further include a lower electrode penetrating through the upper insulation layer and the intermediate insulation layer and being disposed in the peripheral area to make electrically contact with the lower back plate, an intermediate electrode penetrating through the upper insulation layer and being disposed in the peripheral area to make electrically contact with the diaphragm, and an upper electrode being disposed in the peripheral area and making electrically contact with the lower back plate.

In an example embodiment, each of the lower back plate and the upper back plate includes a conductive layer and insulation layers disposed on an upper surface and a lower surface of the conductive layer.

In an example embodiment, the upper insulation layer included in the upper back plate includes a pair of protrusion portions protruding from a lower surface of the upper insulation layer and penetrating through the conductive layer to make contact with the lower insulation layer included in the upper back plate, and wherein the protrusion portions divide the conductive layer into an inner area, an intermediate area surrounding the inner area, and an outer area surrounding the intermediate area.

In an example embodiment, the lower electrode makes contact with the intermediate area of the conductive layer, the intermediate electrode makes contact with the outer area of the conductive layer, and the upper electrode makes contact with the inner area of the conductive layer.

In an example embodiment, the diaphragm defines a plurality of vent holes penetrating therethrough and spaced apart from each other to be arranged along a periphery of the diaphragm, In an example embodiment, the MEMS microphone may further include lower dimples protruding from a lower surface of the diaphragm toward the lower back plate and preventing the diaphragm from being coupled to the lower back plate, and upper dimples protruding from a lower surface of the upper back plate toward the diaphragm and preventing the upper back plate from being coupled to the diaphragm.

According to an example embodiment of the present invention, a method of manufacturing a MEMS microphone comprises forming a lower insulation layer on a substrate, the substrate having a vibration area, a supporting area surrounding the vibration area, and a peripheral area surrounding the supporting area, forming a lower back plate having a plurality of lower acoustic holes on the lower insulation layer, forming an intermediate insulation layer on the lower insulation layer on which the lower back plate is formed, forming a diaphragm and an intermediate anchor being configured to support the diaphragm on the intermediate insulation layer, respectively, forming an upper insulation layer on the intermediate insulation layer on which the diaphragm and the intermediate anchor are formed, and forming a upper back plate having a plurality of upper acoustic holes on the upper insulation layer.

In an example embodiment, forming the lower back plate includes forming a lower anchor being configured to support the lower back plate simultaneously, and forming the upper back plate includes forming an upper anchor being configured to support the upper back plate simultaneously.

In an example embodiment, the lower anchor, the intermediate anchor and the upper anchor are disposed in the supporting area, and the lower anchor is in contact with an upper surface of the substrate, the intermediate anchor is in contact with an upper surface of the lower back plate, and the upper anchor is in contact with an upper surface of the diaphragm.

In an example embodiment, the method of manufacturing a MEMS microphone may further comprise after forming the upper back plate, forming a lower electrode, an intermediate electrode, and an upper electrode in the peripheral area, and the lower electrode penetrates through the upper insulation layer and the intermediate insulation layer to make electrically contact with the lower back plate, the intermediate electrode penetrates through the upper insulation layer to make electrically contact with the diaphragm, and the upper electrode makes electrically contact with the lower back plate.

In an example embodiment, each of the lower back plate and the upper back plate includes a conductive layer and insulation layers disposed on an upper surface and a lower surface of the conductive layer.

In an example embodiment, the upper insulation layer included in the upper back plate includes a pair of protrusion portions protruding from a lower surface of the upper insulation layer and penetrating through the conductive layer to make contact with the lower insulation layer included in the upper back plate, and wherein the protrusion portions divide the conductive layer into an inner area, an intermediate area surrounding the inner area, and an outer area surrounding the intermediate area.

In an example embodiment, the lower electrode makes contact with the intermediate area of the conductive layer, the intermediate electrode makes contact with the outer area of the conductive layer, and the upper electrode makes contact with the inner area of the conductive layer.

In an example embodiment, the method of manufacturing a MEMS microphone may further comprise, after forming the lower electrode, the intermediate electrode, and the upper electrode, patterning the upper back plate to form upper acoustic holes penetrating the back plate, patterning the substrate to form a cavity exposing the lower insulation layer to the vibration area, and performing an etching process using the cavity, the lower acoustic holes, and the upper acoustic holes to remove portions of the lower insulation layer and the intermediate insulation layer, located at positions corresponding the vibration area and the supporting area so that the diaphragm is bendable by acoustic pressure.

In an example embodiment, forming the diaphragm and the intermediate anchor includes forming a plurality of vent holes penetrating through the diaphragm simultaneously with the diaphragm and the intermediate anchor, and the vent holes are formed on the vibration area.

In an example embodiment, the vent holes serve as passages for the etchant to remove the portions of the lower insulation layer and the intermediate insulation layer during the etching process.

According to example embodiments of the present invention as described above, the MEMS microphone includes the intermediate anchor supporting the diaphragm and having a bent shape so that the diaphragm can be elastically supported by the intermediate anchor. Since flexibility of the diaphragm can be remarkably improved without reducing rigidity of the diaphragm as compared with conventional MEMS microphone, sensitivity of the diaphragm can be improved and sagging of the diaphragm can be prevented.

In addition, since the MEMS microphone may include the lower anchor supporting the lower back plate and having a bent shape, and the upper anchor supporting the upper back plate and having a bent shape, the lower back plate and the upper back plate are not supported by a flat plate structure. Therefore, the flexibility of the diaphragm can be further improved without reducing rigidity of the diaphragm, the lower back plate, and the upper back plate in the MEMS microphone.

Further, the diaphragm may have the vent holes serving as passages for an acoustic wave and the etchant so that the acoustic wave can move smoothly and an efficiency of the etching process can be improved.

According to embodiments of the present invention, the lower back plate and the lower anchor are simultaneously formed, the diaphragm and the intermediate anchor are simultaneously formed, and the upper back plate and the upper anchor are simultaneously formed in the method of manufacturing the MEMS microphone. Thus process steps of manufacturing the MEMS microphone can be simplified.

In addition, while removing the lower insulation layer and the intermediate insulation layer from the vibration area and the supporting area, the lower anchor and the intermediate anchor may prevent the etchant from moving to the peripheral area. Therefore, a process margin of the MEMS microphone can be secured and a yield of the MEMS microphone can be improved.

The above summary is not intended to describe each illustrated embodiment or every implementation of the subject matter hereof. The figures and detailed description that follow more particularly exemplify various embodiments.

BRIEF DESCRIPTION OF THE DRAWINGS

Example embodiments can be understood in more detail from the following description taken in conjunction with the accompanying drawings, in which.

Figure 1:
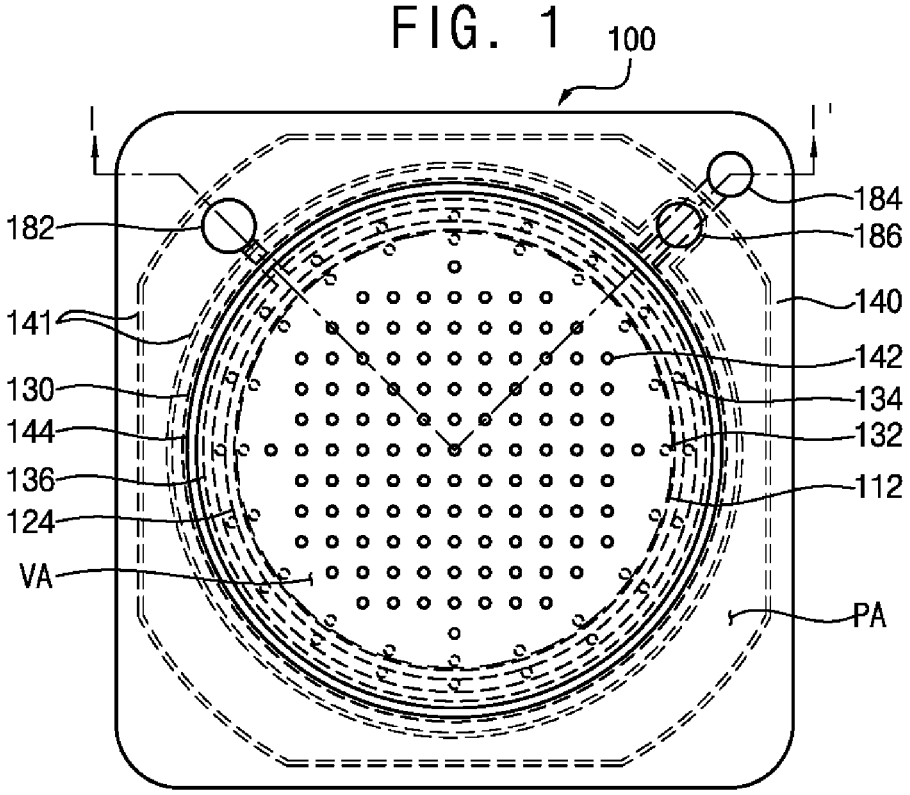
FIG. 1 is a plan view illustrating a MEMS microphone in accordance with an example embodiment of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF EMBODIMENTS

Hereinafter, specific embodiments will be described in more detail with reference to the accompanying drawings. The present invention may, however, be embodied in different forms and should not be construed as limited to the embodiments set forth herein.

As an explicit definition used in this application, when a layer, a film, a region or a plate is referred to as being 'on' another one, it can be directly on the other one, or one or more intervening layers, films, regions or plates may also be present. By contrast, it will also be understood that when a layer, a film, a region or a plate is referred to as being 'directly on' another one, it is directly on the other one, and one or more intervening layers, films, regions or plates do not exist. Also, although terms such as a first, a second, and a third are used to describe various components, compositions, regions, films, and layers in various embodiments of the present invention, such elements are not limited to these terms.

Furthermore, and solely for convenience of description, elements may be referred to as "above" or "below" one another. It will be understood that such description refers to the orientation shown in the Figure being described, and that in various uses and alternative embodiments these elements could be rotated or transposed in alternative arrangements and configurations.

In the following description, the technical terms are used only for explaining specific embodiments while not limiting the scope of the present invention. Unless otherwise defined herein, all the terms used herein, which include technical or scientific terms, may have the same meaning that is generally understood by those skilled in the art.

The depicted embodiments are described with reference to schematic diagrams of some embodiments of the present invention. Accordingly, changes in the shapes of the diagrams, for example, changes in manufacturing techniques and/or allowable errors, are sufficiently expected. The Figures are not necessarily drawn to scale. Accordingly, embodiments of the present invention are not described as being limited to specific shapes of areas described with diagrams and include deviations in the shapes and also the areas described with drawings are entirely schematic and their shapes do not represent accurate shapes and also do not limit the scope of the present invention.

Figure 2:
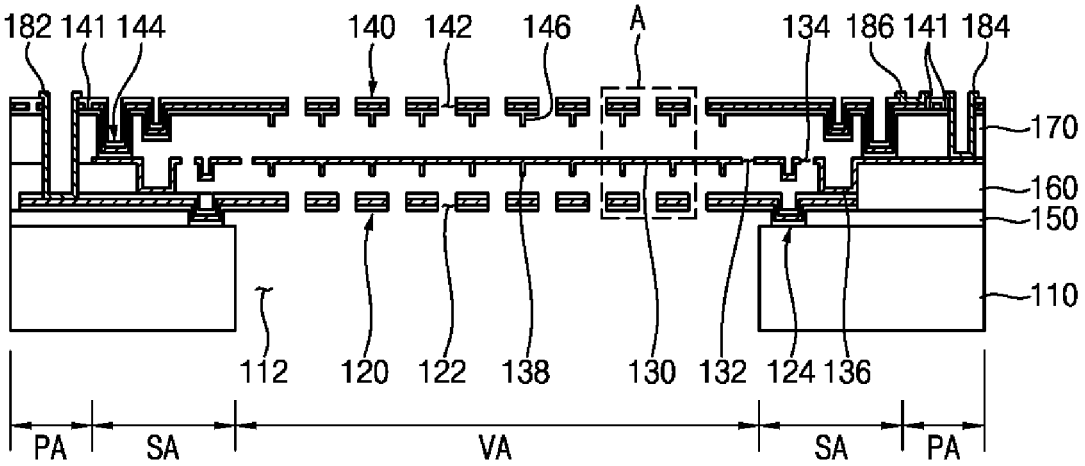
FIG. 2 is a cross sectional view taken along a line I-I' of FIG. 1.
Figure 3:
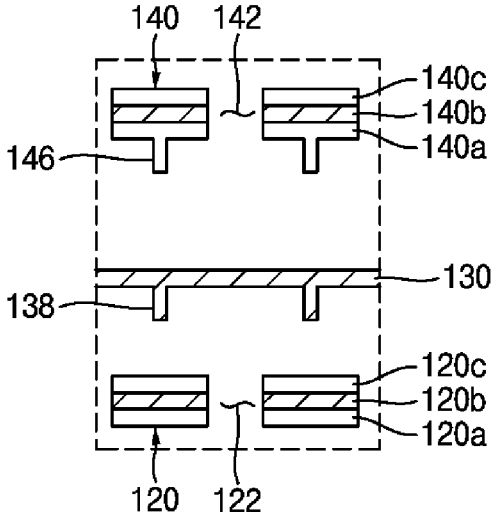
FIG. 3 is a enlarged view illustrating a portion "A" shown in FIG. 2.

FIG. 1 is a plan view illustrating a MEMS microphone in accordance with an example embodiment of the present invention, FIG. 2 is a cross sectional view taken along a line I-I' of FIG. 1, and FIG. 3 is an enlarged view illustrating a portion "A" shown in FIG. 2.

Referring to FIGS. 1 to 3, a MEMS microphone 100 in accordance with an example embodiment of the present invention is capable of creating a displacement in response to an applied acoustic pressure to convert an acoustic wave into an electrical signal and output the electrical signal. The MEMS microphone 100 includes a substrate 110, a lower back plate 120, a diaphragm 130, and an upper back plate 140.

The substrate 110 may be divided into a vibration area VA, a supporting area SA surrounding the vibration area VA, and a peripheral area PA surrounding the supporting area SA. A cavity 112 is formed in the vibration area VA of the substrate 110.

In an example embodiment, the cavity 112 may have a cylindrical shape. Further, the cavity 112 may have a shape and a size corresponding to those of the vibration area VA.

The lower back plate 120 is disposed over the substrate 110 in the vibration area VA. The lower back plate 120 may cover the cavity 112. The lower back plate 120 may be exposed through the cavity 112.

The lower back plate 120 may have a shape of a circular disc. A portion of the lower back plate 120 may extend through the supporting area SA to the peripheral area PA.

As shown in FIG. 3, the lower back plate 120 may include a first lower insulation layer 120*a*, a first conductive layer 120*b*, and a first upper insulation layer 120*c*.

The first conductive layer 120*b* may be disposed between the first lower insulation layer 120*a* and the first upper insulation layer 120*c*. The first conductive layer 120*b* can be made of a silicon material such as polysilicon, and the first lower insulation layer 120*a* and the first upper insulation layer 120*c* can be made of a nitride material such as a silicon nitride.

The lower back plate 120 may have a doped portion being doped with impurities through an ion implantation process. In an example embodiment, the polysilicon, which is a material forming the first conductive layer 120*b*, may be doped with the impurities.

The lower back plate 120 may include a plurality of lower acoustic holes 122 through which the acoustic wave flow. The lower acoustic holes 122 may be formed through the lower back plate 120.

The lower back plate 120 may include a lower anchor 124.

The lower anchor 124 may be disposed in the supporting area SA, and support the lower back plate 120 to space the lower back plate 120 from the substrate 110. The lower back plate 120 is bent toward the substrate 110 to form the lower anchor 124. As shown in FIG. 2, a lower surface of the lower anchor 120 may be in contact with an upper surface of the substrate 110 and may be fixed to the upper surface of the substrate 110.

The lower anchor 124 may have an approximately ring shape, and may be disposed to surround the cavity 112. In an example of embodiment, the lower anchor 124 may be integrally formed with the lower back plate 120. The lower anchor 124 may have a U-shaped vertical section.

The diaphragm 130 may be disposed over the lower back plate 120 and spaced apart from the lower back plate 120. The diaphragm 130 may have a membrane structure. The diaphragm 130 may generate a displacement due to an applied acoustic pressure. Since the diaphragm 130 is spaced apart from the lower back plate 120, the diaphragm 130 may vibrate due to the acoustic pressure.

The diaphragm 130 may be made of a silicon material such as polysilicon. The diaphragm 130 may have a doped portion being doped with impurities through an ion implantation process.

The diaphragm 130 may have a shape of a circular disc. A portion of the diaphragm 130 may extend through the supporting area SA to the peripheral area PA.

The diaphragm 130 may include an intermediate anchor 136.

The intermediate anchor 136 may be disposed in the supporting area SA, and support the diaphragm 130 to space the diaphragm 130 from the lower back plate 120. The diaphragm 130 is bent toward the lower back plate 120 to form the intermediate anchor 136. A lower surface of the intermediate anchor 136 may be in contact with an upper surface of the lower back plate 120 and may be fixed to the upper surface of the lower back plate 120.

The intermediate anchor 136 may be arranged along a periphery of the diaphragm 130, and have an approximately ring shape. In an example of embodiment, the intermediate anchor 136 may be integrally formed with the diaphragm 130. The intermediate anchor 136 may have a U-shaped vertical section.

The diaphragm 130 may have a plurality of first vent holes 132 and a plurality of second vent holes 134.

Each of the first vent holes 132 and the second vent holes 134 may be disposed inside of the intermediate anchor 136 in a horizontal direction. The each of the first vent holes 132 and the second vent holes 134 may be arranged along the intermediate anchor 136 in a ring shape and may be spaced apart from each another. The first vent holes 132 and the second vent holes 134 are formed by penetrating through the diaphragm 130 in a vertical direction.

Each of the first vent holes 132 may serve as a passage for the acoustic wave. Further, each of the first vent holes 132 may also function as a passage for an etchant to be used in a process of manufacturing the MEMS microphone 100. Each of the second vent holes 134 may serve as a passage for the acoustic wave. Further, each of the second vent holes 134 may mainly function as a passage for the etchant to be used in the process of manufacturing the MEMS microphone 100.

The second vent holes 134 are located outside of the first vent holes 132 in the horizontal direction. In an example of embodiment, the first vent holes 132 may be located inside of the lower anchor 124 and the second vent holes 134 may be located outside of the lower anchor 124.

The first vent holes 132 and the second vent holes 134 may be positioned in the vibration area VA. Alternatively, the first vent holes 132 and the second vent holes 134 may be positioned in a boundary area between the vibration area VA and the supporting area SA or in the supporting area SA adjacent to the vibration area VA.

The diaphragm 130 may include lower dimples 138. The lower dimples 138 may protrude from a lower surface of the diaphragm 130 toward the lower back plate 120. Thus, the lower dimples 138 can prevent the diaphragm 130 from being coupled to the upper surface of the lower back plate 120.

Particularly, when the acoustic pressure is applied to the diaphragm 130, the diaphragm 120 can be bent in a generally semispherical or paraboloid shape toward the lower back plate 120 or the upper back plate 140, and then can return to its initial position. The degree of bending of the diaphragm 130 may vary depending on a magnitude of the applied acoustic pressure. Even if the diaphragm 130 is bent so much as to contact the lower back plate 120, the lower dimples 138 may keep the diaphragm 130 and the lower back plate 120 sufficiently separated from each other that the diaphragm 130 is able to return to the initial position.

The upper back plate 140 may be disposed over the diaphragm 130 to be spaced apart from the diaphragm 130.

The upper back plate 140 may be disposed in the vibration area VA, the supporting area SA, and the peripheral area PA.

As shown in FIG. 3, the upper back plate 140 may include a second lower insulation layer 140*a*, a second conductive layer 140*b*, and a second upper insulation layer 140*c*.

The second conductive layer 140*b* may be disposed between the second lower insulation layer 140*a* and the second upper insulation layer 140*c*. The second conductive layer 140*b* can be made of a silicon material such as polysilicon, and the second lower insulation layer 140*a* and the second upper insulation layer 140*c* can be made of a nitride material such as a silicon nitride.

The upper back plate 140 may have a doped portion being doped with impurities through an ion implantation process. In an example embodiment, the polysilicon, which is a material forming the second conductive layer 140*b*, may be doped with the impurities.

The second upper insulation layer 140*c* may include a pair of protrusion portions 141 protruding from a lower surface of the upper insulation layer 140*c* and penetrating the second conductive layer 140*b* to make contact with the second lower insulation layer 140*a*. The protrusion portions 141 may have a ring shape, and may be disposed in the supporting area SA and the peripheral area PA.

The protrusion portions 141 may divide the second conductive layer 140*b* into an inner area, an intermediate area surrounding the inner area, and an outer area surrounding the intermediate area. A portion of the inner area of the second conductive layer 140*b* may extend to the peripheral area PA.

In an example embodiment, the inner area may be a conductive area in which impurities are doped, and the outer area may be a non-conductive area in which the impurities are not doped. Alternatively, both the inner area and the outer area may be conductive areas.

The upper back plate 140 may include an upper anchor 144.

The upper anchor 144 may be disposed in the supporting area SA, and support the upper back plate 140 to space the upper back plate 140 from the diaphragm 130. The upper back plate 140 is bent toward the diaphragm 130 to form the upper anchor 144. As shown in FIG. 2, a lower surface of the upper anchor 120 may be in contact with an upper surface of the diaphragm 130 and may be fixed to the upper surface of the diaphragm 130.

The upper anchor 144 may have an approximately ring shape, and may be disposed along a circumference of the upper back plate 140. In an example embodiment, the upper anchor 144 may be integrally formed with the upper back plate 140. The upper anchor 144 may have a U-shaped vertical section.

The upper back plate 140 may include upper dimples 146. The upper dimples 146 may protrude from a lower surface of the upper back plate 140 toward the lower back plate 120. Thus, the upper dimples 146 can prevent the upper back plate 140 from being entirely in contact with or permanently/semi-permanently coupled to the upper surface of the lower back plate 120 by reducing the contact area between those two components.

Particularly, even if the diaphragm 130 is bent so much as to contact the upper back plate 140, the upper dimples 146 may keep the diaphragm 130 and the upper back plate 140 sufficiently separated from each other that the diaphragm 130 is able to return to the initial position.

Since the upper back plate 140 is also disposed in the peripheral area PA, the upper back plate 140 is stably supported by an upper insulation layer 170 described later. Therefore, sagging of the upper back plate 140 may be prevented.

In an example embodiment, the MEMS microphone 100 may further include a lower insulation layer 150, an intermediate insulation layer 160, the upper insulation layer 170, a lower electrode 182, an intermediate electrode 184, and an upper electrode 186.

In embodiments, the lower insulation layer 150 may be disposed on the upper surface of the substrate 110 and may support the lower back plate 120. The lower insulation layer 150 is positioned in the peripheral area PA and the supporting area SA. Specifically, the lower insulation layer 150 may be located outside of the lower anchor 124 in the horizontal direction.

The intermediate insulation layer 160 may be disposed on an upper surface of the lower insulation layer 150 and may support the diaphragm 130. The intermediate insulation layer 160 is positioned in the peripheral area PA and the supporting area SA. Specifically, the intermediate insulation layer 160 may be located outside of the intermediate anchor 136 in the horizontal direction.

The upper insulation layer 170 may be disposed on an upper surface of the intermediate insulation layer 160 and may support the upper back plate 140. The upper insulation layer 170 is positioned in the peripheral area PA and the supporting area SA. Specifically, the upper insulation layer 170 may be located outside of the upper anchor 144 in the horizontal direction.

The lower electrode 182 may be disposed in the peripheral area PA and penetrates through the upper back plate 140, the upper insulation layer 170, and the intermediate insulation layer 160 to make electrically contact with the lower back plate 120. Specifically, the lower electrode 182 may make contact with the portion of the lower back plate 120 extending to the peripheral area PA. The lower electrode 182 may penetrate through the first upper insulation layer 120*c* to make contact with the first conductive layer 120*b*.

The intermediate electrode 184 may be disposed in the peripheral area PA and penetrates through the upper back plate 140 and the upper insulation layer 170 to make electrically contact with the diaphragm 130. Specifically, the intermediate electrode 184 may make contact with the portion of the diaphragm 130 extending to the peripheral area PA.

The upper electrode 186 may be disposed in the peripheral area PA and make electrically contact with the upper back plate 140. Specifically, the upper electrode 186 may make contact with the portion of the inner area of the second conductive layer 140*b* extending to the peripheral area PA. The upper electrode 186 may penetrate through the second upper insulation layer 140*c* to make contact with the second conductive layer 140*b*.

In addition, the lower electrode 182 makes contact with the intermediate area of the second conductive layer 140*b* while passing through the intermediate area, the intermediate electrode 184 makes contact with the outer area of the second conductive layer 140*b* while passing through the outer area, and the upper electrode 186 makes contact with the inner area of the second conductive layer 140*b*. Alternatively, no shown in detail in figures, the lower electrode 182 makes contact with the outer area of the second conductive layer 140*b* while passing through the outer area, the intermediate electrode 184 makes contact with the intermediate area of the second conductive layer 140*b* while passing through the intermediate area, and the upper electrode 186 makes contact with the inner area of the second conductive layer 140*b*.

Since the lower electrode 182, the intermediate electrode 184, and the upper electrode 186 make in contact with different areas of the inner area, the intermediate area, and the outer area of the second conductive layer 140*b*, the lower electrode 182, the intermediate electrode 184, and the upper electrode 186 are not electrically connected to each other by the second conductive layer 140*b*.

As described above, the MEMS microphone 100 includes the intermediate anchor 134 supporting the diaphragm 130 and having a bent shape so that the diaphragm 130 can be elastically supported by the intermediate anchor 134. Since flexibility of the diaphragm 130 can be remarkably improved without reducing rigidity of the diaphragm 130 as compared with conventional MEMS microphone, sensitivity of the diaphragm 130 can be improved and the sagging of the diaphragm 130 can be prevented.

Also, since the MEMS microphone 100 may include the lower anchor 124 supporting the lower back plate 120 and having a bent shape, and the upper anchor 144 supporting the upper back plate 140 and having a bent shape, the lower back plate 120 and the upper back plate 140 are not supported by a flat plate structure. Therefore, the flexibility of the diaphragm 130 can be further improved without reducing the rigidity of the diaphragm 130, the lower back plate 120, and the upper back plate 140 in the MEMS microphone 100.

In addition, the lower anchor 124, the intermediate anchor 136, and the upper anchor 144 have a ring shape to make contact with the substrate 110, the lower back plate 120, and the vibration plate 130, respectively. Therefore, the lower anchor 124, the intermediate anchor 136, and the upper anchor 144 may block movement of the etchant for removing the lower insulation layer 150, the intermediate insulation layer 160, and the upper insulation layer 170 into the peripheral area PA.

Further, the diaphragm 130 may have the first vent holes 132 and the second vent holes 134 serving as passages for an acoustic wave and the etchant so that the acoustic wave can move smoothly and an efficiency of the etching process can be improved.

Hereinafter, a method of manufacturing a MEMS microphone will be described in detail with reference to the drawings.

Figure 4:
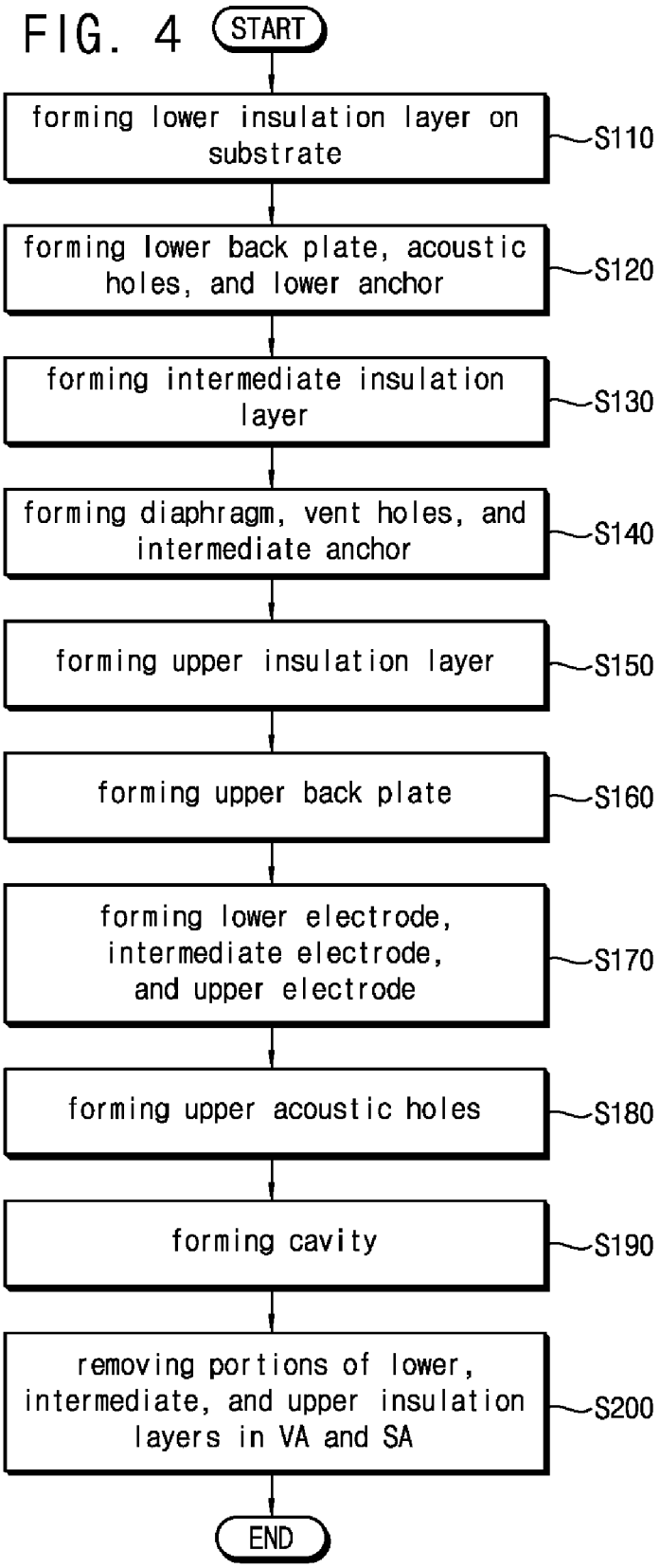
FIG. 4 is a flow chart illustrating a method of manufacturing a MEMS microphone in accordance with an example embodiment of the present invention.

FIG. 4 is a flow chart illustrating a method of manufacturing a MEMS microphone in accordance with an example embodiment of the present invention, and FIGS. 5 to 15 are cross sectional views illustrating a method of manufacturing a MEMS microphone in accordance with an example embodiment of the present invention.

Figure 5:
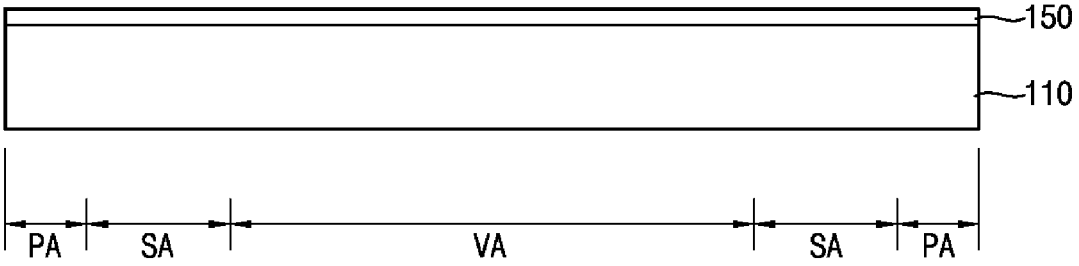
FIGS. 5 to 15 are cross sectional views illustrating a method of manufacturing a MEMS microphone in accordance with an example embodiment of the present invention.

Referring to FIGS. 4 and 5, according to example embodiments of a method for manufacturing a MEMS microphone, a lower insulation layer 150 is formed on a substrate 110 at S110.

The lower insulation layer 150 may be formed by a deposition process, and the lower insulation layer 150 may be made of an oxide such as silicon oxide or TEOS.

Figure 6:
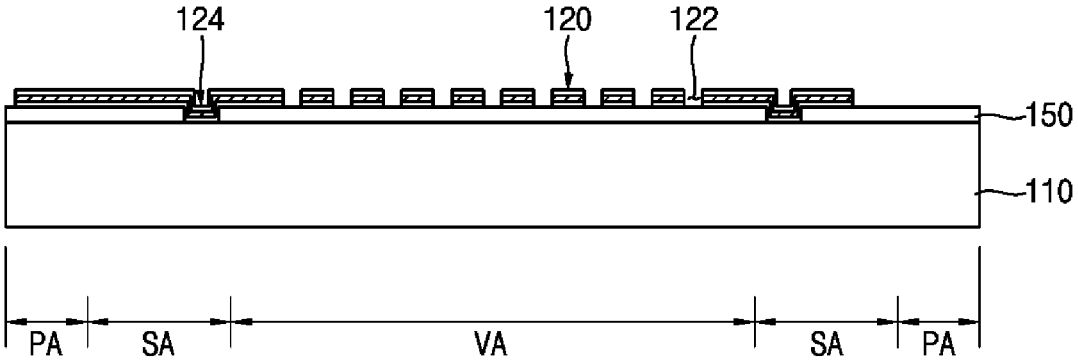

Referring to FIGS. 4 and 6, a lower back plate 120, lower acoustic holes 122, and a lower anchor 124 are formed on the lower insulation layer 150 at S120.

Hereinafter, the S120 for forming the lower back plate 120, the lower acoustic holes 122, and the lower anchor 124 will described in detail as follows.

First, a lower anchor channel for forming the lower anchor 124 is formed by patterning the lower insulation layer 150 through an etching process. Here, the lower anchor channel may partially expose the substrate 110. The lower anchor channel may be formed in the supporting area SA on the substrate 110. In an example embodiment, the lower anchor channel may be formed to have a ring shape to surround the vibration area VA.

Next, a first lower insulation layer 120*a*, a first conductive layer 120*b*, and a first upper insulation layer 120*c* are sequentially deposited on the lower insulation layer 150 on which the lower anchor channel is formed. In an example embodiment, the first conductive layer 120*b* is made of a silicon material such as polysilicon, and the first lower insulation layer 120*a* and the first upper insulation layer 120*c* are made of a nitride such as silicon nitride.

After depositing the first conductive layer 120*b*, impurities may be doped into the first conductive layer 120*b* through an ion implantation process.

Then, the first lower insulation layer 120*a*, the first conductive layer 120*b*, and the first upper insulation layer 120*c* are patterned through an etching process to form the lower back plate 120, the lower acoustic holes 122, and the lower anchor 124.

The lower back plate 120 may have a shape of a circular disc. A portion of the lower back plate 120 may extend to the peripheral area PA.

The lower acoustic holes 122 may be located in the vibration area SA and may penetrate the lower back plate 120.

The lower anchor 124 may be located in the supporting area SA and may have a ring shape. The lower anchor 124 may be disposed along a circumference of the lower back plate 120.

Figure 7:
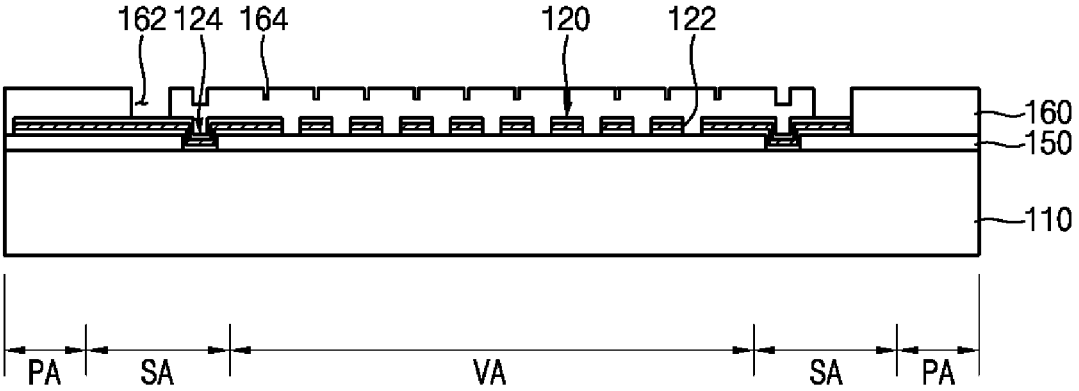

Referring to FIGS. 4 and 7, an intermediate insulation layer 160 is formed on the lower insulation layer 150 on which the lower back plate 120, the lower acoustic holes 122, and the lower anchor 124 are formed at S130.

The intermediate insulation layer 160 may be formed by a deposition process. The intermediate insulation layer 160 may be made of the same material as that of the lower insulation layer 150. The intermediate insulation layer 160 may be made of an oxide such as silicon oxide or TEOS.

Then, the intermediate insulation layer 160 is patterned through an etching process to form an intermediate anchor channel 162 in the supporting area SA. Here, the intermediate anchor channel 162 may partially expose the lower back plate 120. The intermediate anchor channel 162 may be formed to have a ring shape to surround the lower back plate 120.

In addition, lower dimple holes 164 for forming lower dimples 138 (see FIG. 2) are formed by patterning the intermediate insulation layer 160 through an etching process. The lower dimple holes 164 may be formed in the vibration area VA. The intermediate insulation layer 160 may be partially etched so that the lower dimples 138 protrude from a lower surface of a diaphragm 130 toward the lower back plate 120.

Figure 8:
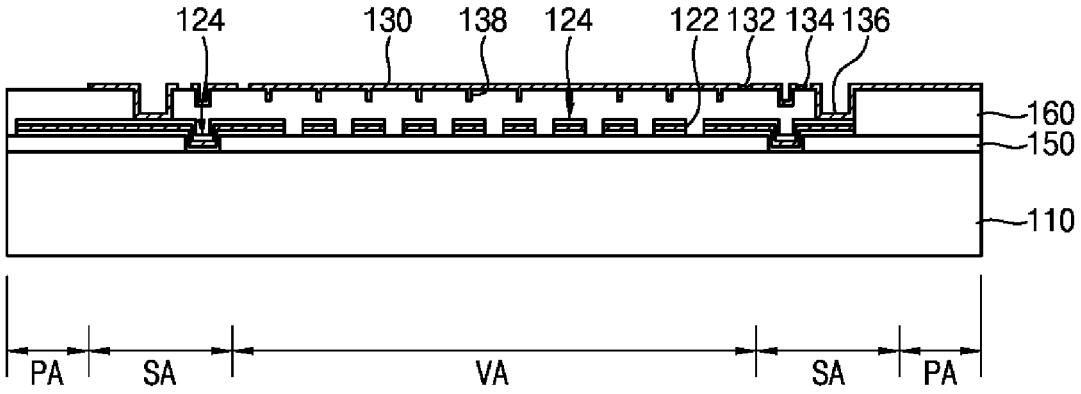

Referring to FIGS. 4 and 8, a diaphragm 130 and an intermediate anchor 136 are formed on the intermediate insulation layer 160 on which the intermediate anchor channel 162 and the lower dimple holes 164 are formed at S140.

Hereinafter, the S140 for forming the diaphragm 130 and the intermediate anchor 136 will be described in detail as follows.

First, a silicon layer is deposited on the intermediate insulation layer 160 on which the intermediate anchor channel 162 and the lower dimple holes 164 are formed. In an example embodiment, the silicon layer may be made of polysilicon.

Next, impurities are doped into the silicon layer through an ion implantation process.

Then, the silicon layer is patterned through an etching process to form the diaphragm 130 and the intermediate anchor 136.

The diaphragm 130 may have a shape of a circular disc. A portion of the diaphragm 130 may extend to the peripheral area PA.

The intermediate anchor 136 may be located in the supporting area SA and may have a ring shape. The intermediate anchor 136 may be disposed along a circumference of the diaphragm 130.

The lower dimples 138 are formed on the lower dimple holes 164 by depositing the silicon layer.

First vent holes 132 and second vent holes 134 may also be formed on the diaphragm 130. The first vent holes 132 and the second vent holes 134 may be positioned in the vibration area VA. Alternatively, the first vent holes 132 and the second vent holes 134 may be positioned in a boundary area between the vibration area VA and the supporting area SA or in the supporting area SA adjacent to the vibration area VA.

The second vent holes 134 are located outside of the first vent holes 132 in the horizontal direction. In an example of embodiment, the first vent holes 132 may be located inside of the lower anchor 124 and the second vent holes 134 may be located outside of the lower anchor 124.

Figure 9:
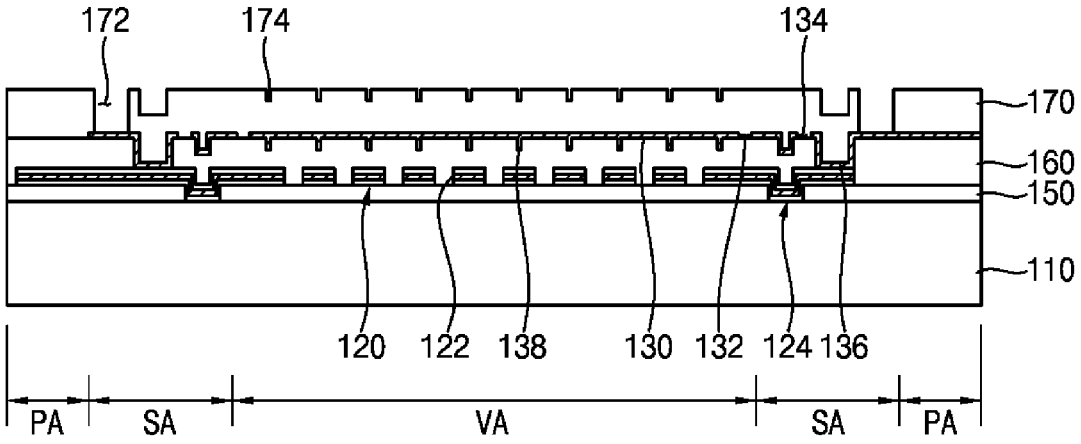

Referring to FIGS. 4 and 9, an upper insulation layer 170 is formed on the intermediate insulation layer 160 on which the diaphragm 130 and the intermediate anchor 136 are formed at S150.

The upper insulation layer 170 may be formed by a deposition process. The upper insulation layer 170 may be made of the same material as that of the lower insulation layer 150. The upper insulation layer 170 may be formed of an oxide such as silicon oxide or TEOS.

Then, the upper insulation layer 170 is patterned through an etching process to form an upper anchor channel 172 in the supporting area SA. Here, the upper anchor channel 172 may partially expose the diaphragm 130. The upper anchor channel 172 may be formed to have a ring shape to surround the diaphragm 130.

In addition, upper dimple holes 174 for forming upper dimples 146 (see FIG. 2) are formed by patterning the upper insulation layer 170 through an etching process. The upper dimple holes 174 may be formed in the vibration area VA. The upper insulation layer 170 may be partially etched so that the upper dimples 146 protrude from a lower surface of an upper back plate 140 toward the diaphragm 130.

Figure 10:
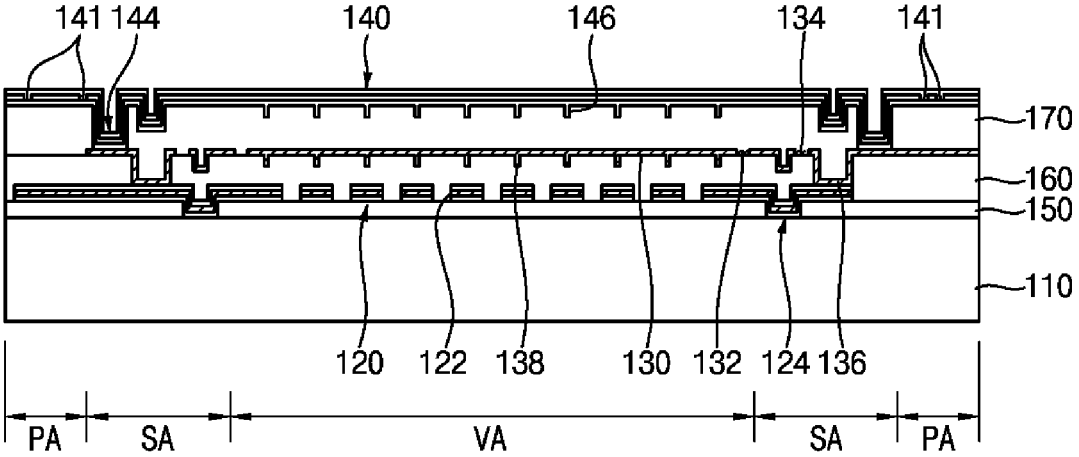

Referring to FIGS. 4 and 10, the upper back plate 140 and an upper anchor 144 are formed on the upper insulation layer 170 on which the upper anchor channel 172 and the upper dimple holes 174 are formed at S160.

Hereinafter, the S160 for forming the upper back plate 140 and the upper anchor 144 will be described in detail as follows.

First, a second lower insulation layer 140*a* and a second conductive layer 140*b* are sequentially deposited on the upper insulation layer 170 on which the upper anchor channel 172 and the upper dimple holes 174 are formed. In an example embodiment, the second conductive layer 140*b* may be made of a silicon material such as polysilicon, and the second lower insulation layer 140*a* may be made of a nitride such as silicon nitride. Here, the second lower insulation layer 140*a* and the second conductive layer 140*b* are formed in the vibration area VA, the supporting area SA, and the peripheral area PA.

Then, the second conductive layer 140*b* is patterned through an etching process to form a pair of protrusion channels partially exposing the second lower insulation layer 140*a*. The protrusion channels may have a ring shape, and may be disposed in the supporting area SA and the peripheral area PA.

The protrusion channels may divide the second conductive layer 140*b* into an inner area, an intermediate area surrounding the inner area, and an outer area surrounding the intermediate area. A portion of the inner area of the second conductive layer 140*b* may extend to the peripheral area PA.

In addition, impurities may be doped into the second conductive layer 140*b* through an ion implantation process. The impurity may be doped only in the inner area. Alternatively, the impurity may be doped in both the inner area and the outer area may be doped.

Then, a second upper insulation layer 140*c* is deposited on the second conductive layer 140*b* on which the protrusion channels is formed. In an example embodiment, the second upper insulation layer 140*c* may be made of a nitride such as silicon nitride.

A pair of protrusion portions 141 may be formed in the protrusion channels. The protrusion portions 141 may protrude from a lower surface of the upper insulation layer 140*c* and penetrate through the second conductive layer 140*b* to make contact with the second lower insulation layer 140*a*. The protrusions 141 may divide the second conductive layer 140*b* into the inner area, the intermediate area, and the outer area.

The upper back plate 140 and the upper anchor 144 are formed by depositing the second lower insulation layer 140*a*, the second conductive layer 140*b*, and the second upper insulation layer 140*c*.

The upper back plate 140 is disposed in the vibration area VA, the supporting area SA, and the peripheral area PA. Since the upper back plate 140 is stably supported by the upper insulation layer 170, sagging of the upper back plate 140 can be prevented.

The upper anchor 144 is located in the supporting area SA, and may have a ring shape. The upper anchor 144 may be disposed along a circumference of the diaphragm 130.

The upper dimples 146 are formed on the upper dimple holes 174 by depositing the second lower insulation layer 140*a*.

Figure 11:
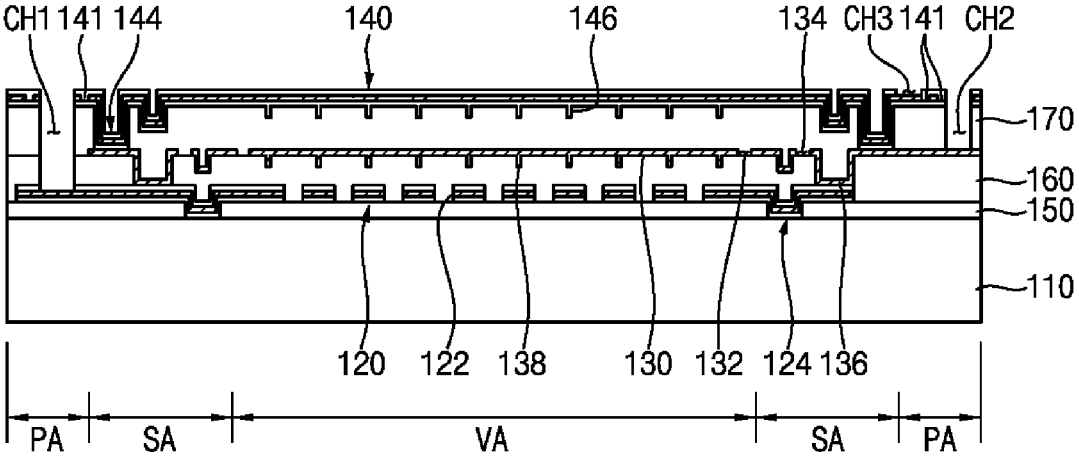
Figure 12:
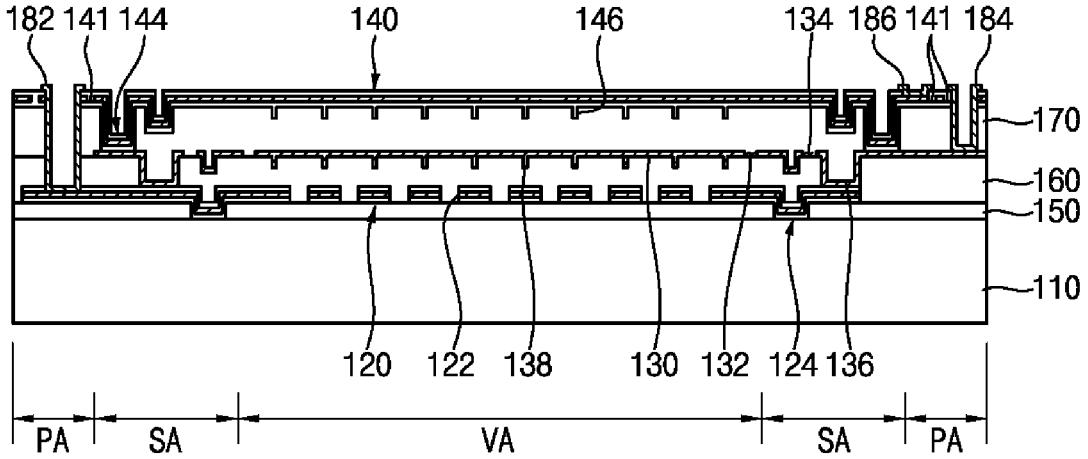

Referring to FIGS. 4, 11, and 12, the intermediate insulation layer 160, the upper insulation layer 170, and the upper back plate 140 are patterned to form a lower electrode 182, an intermediate electrode 184, and an upper electrode 186 at S170.

Hereinafter, the S170 for forming the lower electrode 182, the intermediate electrode 184, and the upper electrode 186 will be described in detail as follows.

The upper back plate 140, the upper insulation layer 170, the intermediate insulation layer 160, and the first upper insulation layer 120*c* are patterned in the peripheral area PA to form the first electrode hole CH1. The first electrode hole CH1 exposes the first conductive layer 120*b* at the portion of the lower back plate 120 extending to the peripheral area PA.

The upper back plate 140 and the intermediate insulation layer 160 are patterned in the peripheral area PA to form a second electrode hole CH2. The second electrode hole CH2 exposes the portion of the diaphragm 130 extending to the peripheral area PA The second upper insulation layer 140*c* is patterned on the upper back plate 140 in the peripheral area PA to form a third electrode hole CH3. The third electrode hole CH3 exposes the portion of the inner area of the second conductive layer 140*b* extending to the peripheral area PA.

The lower electrode 182 makes contact with the intermediate area of the second conductive layer 140*b* while passing through the intermediate area, the intermediate electrode 184 makes contact with the outer area of the second conductive layer 140*b* while passing through the outer area, and the upper electrode 186 makes contact with the inner area of the second conductive layer 140*b*. Alternatively, in an embodiment not shown in detail in figures, the lower electrode 182 makes contact with the outer area of the second conductive layer 140*b* while passing through the outer area, the intermediate electrode 184 makes contact with the intermediate area of the second conductive layer 140*b* while passing through the intermediate area, and the upper electrode 186 makes contact with the inner area of the second conductive layer 140*b*.

Next, a thin film (not shown in detail in figures) is deposited on the upper back plate 140 on which the first electrode hole CH1, the second electrode hole CH2, and the third electrode hole CH3 are formed. Here, the thin film may be made of a conductive metal material.

The thin film is patterned to form the lower electrode 182, the intermediate electrode 184, and the upper electrode 186. Accordingly, the lower electrode 182 may be disposed in the peripheral area PA and penetrates through the upper back plate 140, the upper insulation layer 170, the intermediate insulation layer 160, and the first upper insulation layer 120*c* to make electrically contact with the first conductive layer 120*b*. The intermediate electrode 184 may be disposed in the peripheral area PA and penetrates through the upper back plate 140 and the upper insulation layer 170 to make electrical contact with the diaphragm 130. The upper electrode 186 may be disposed in the peripheral area PA and penetrate through the second upper insulation layer 140*c* to make electrical contact with the inner area of the second conductive layer 140*b*.

In addition, since the lower electrode 182, the intermediate electrode 184, and the upper electrode 186 make in contact with different areas of the inner area, the intermediate area, and the outer area of the second conductive layer 140*b*, The lower electrode 182, the intermediate electrode 184, and the upper electrode 186 are not electrically connected to each other by the second conductive layer 140*b*.

Figure 13:
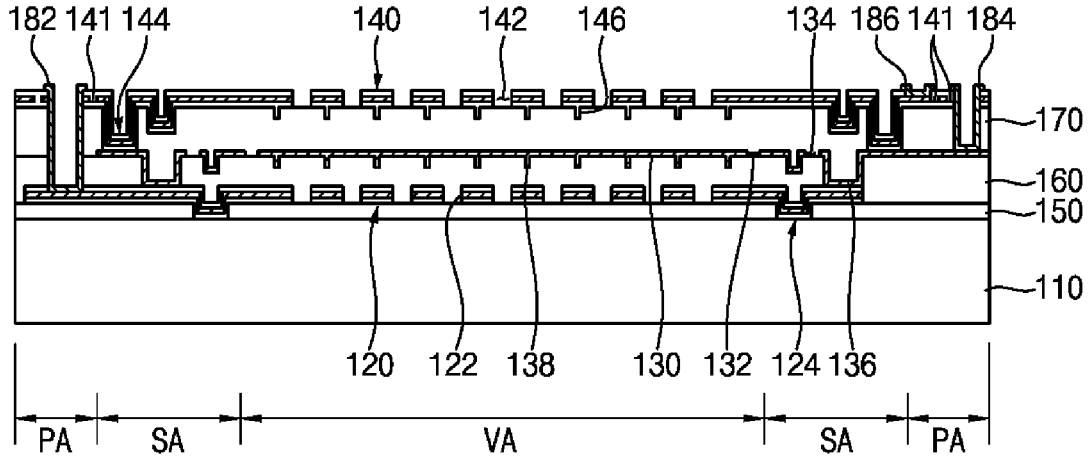

Referring to FIGS. 4 and 13, the upper back plate 140 is patterned to form upper acoustic holes 142 at S180.

The upper acoustic holes 142 are disposed in the vibration area SA and may penetrate through the upper back plate 140.

Figure 14:
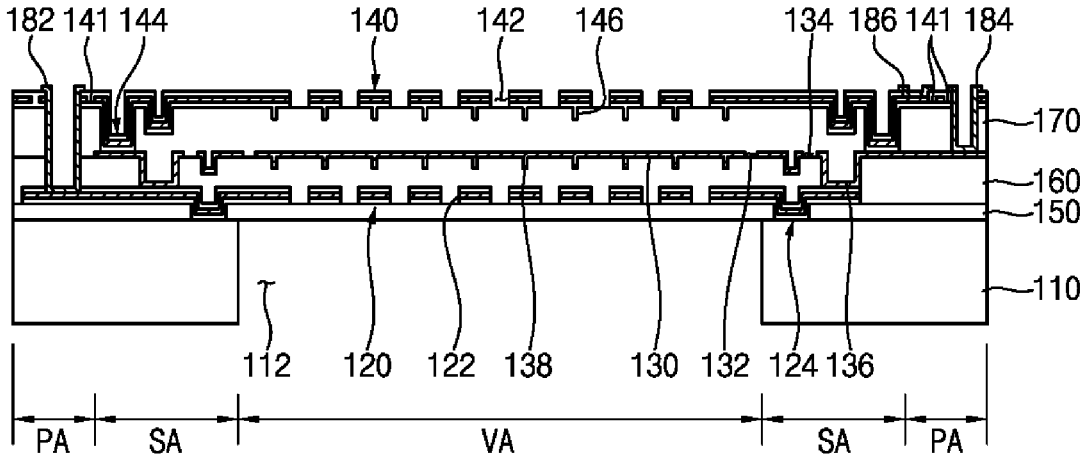

Referring to FIGS. 4 and 14, after forming the upper acoustic holes 142, the substrate 110 is patterned to form a cavity 112 in the vibration area VA at S190.

Here, the lower insulation layer 150 is partially exposed through the cavity 112.

Figure 15:
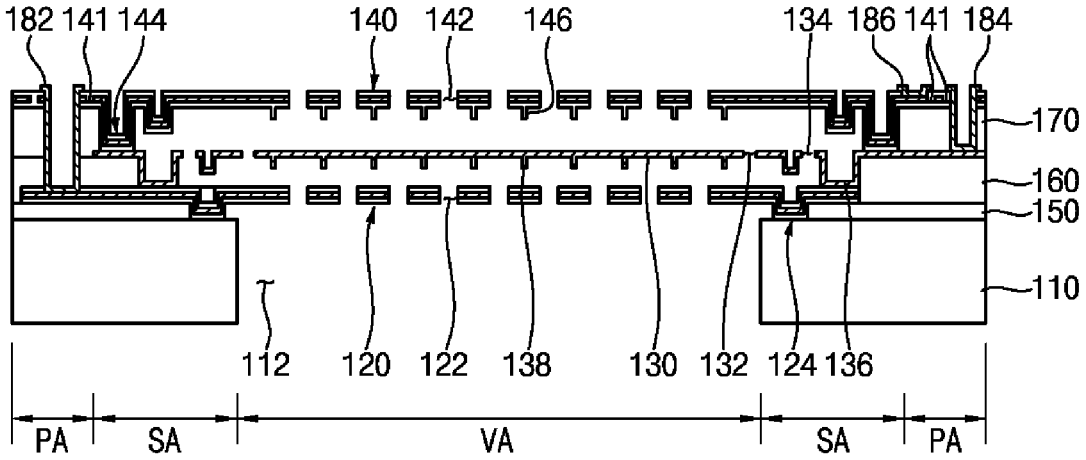

Referring to FIGS. 4 and 15, the lower insulation layer 150, the intermediate insulation layer 160, and the upper insulation layer 170 are removed in the vibration area VA and the supporting area SA through an etching process using the cavity 112, the lower acoustic holes 122, the first vent holes 132, the second vent holes 134, and the upper acoustic holes 142 at S190.

As a result, the lower back plate 120 is exposed through the cavity 112, and an air gap is formed both between the diaphragm 130 and the lower back plate 120, and between the diaphragm 130 and the upper back plate 140. Here, the cavity 112, the lower acoustic holes 122, the first vent holes 132, the second vent holes 134, and the upper acoustic holes 142 may serve as passages of etchant for removing the lower insulation layer 150, The intermediate insulation layer 160 and the upper insulation layer 170.

In particular, the lower anchor 124, the intermediate anchor 136, and the upper anchor 144 may block movement of the etchant during removing the lower insulation layer 150, the intermediate insulation layer 160, and the upper insulation layer 170 in the vibration area VA and the supporting area SA at the S190. Accordingly, it is easy to control an etching amount of the lower insulation layer 150, the intermediate insulation layer 160 and the upper insulation layer 170.

In an example embodiment hydrogen fluoride vapor (HF vapor) may be used as an etchant for removing the lower insulation layer 150, the intermediate insulation layer 160, and the upper insulation layer 170.

As described above, the lower back plate 120 and the lower anchor 124 are simultaneously formed, the diaphragm 130 and the intermediate anchor 136 are simultaneously formed, and the upper back plate 140 and the upper anchor 144 are simultaneously formed in the method of manufacturing the MEMS microphone. Thus the process of manufacturing the MEMS microphone can be simplified.

In addition, while removing the lower insulation layer 150, the intermediate insulation layer 160, and the upper insulation layer 170 in the vibration area and the supporting area, the lower anchor 124, the intermediate anchor 136, and the upper anchor 144 may prevent the etchant from moving to the peripheral area PA. Therefore, a process margin of the MEMS microphone can be secured and a yield of the MEMS microphone can be improved.

Further, since the etchant may also move through the first vent holes 132 and the second vent holes 134 of the diaphragm 130, efficiency of the etching process may be improved.

Although the MEM microphone has been described with reference to the specific embodiments, they are not limited thereto. Therefore, it will be readily understood by those skilled in the art that various modifications and changes can be made thereto without departing from the spirit and scope of the appended claims.

Various embodiments of systems, devices and methods have been described herein. These embodiments are given only by way of example and are not intended to limit the scope of the invention. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the invention.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention can comprise a combination of different individual features selected from different individual embodiments, as understood by persons of ordinary skill in the art. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112(f) of 35 U.S.C. are not to be invoked unless the specific terms "means for" or "step for" are recited in a claim.

What is claimed is:

1. A Micro-Electro-Mechanical Systems (MEMS) microphone comprising:

a substrate presenting a vibration area, a supporting area surrounding the vibration area, and a peripheral area surrounding the supporting area, the substrate defining a cavity formed in the vibration area;

a lower back plate being disposed over the substrate to cover the cavity and having a plurality of lower acoustic holes;

a diaphragm being disposed over the lower back plate, the diaphragm being spaced apart from the lower back plate and configured to generate a displacement thereof in response to an applied acoustic pressure;

an upper back plate being disposed over the diaphragm, the upper back plate being spaced apart from the diaphragm and having a plurality of upper acoustic holes; and an intermediate anchor being in contact with an upper surface of the lower back plate in the supporting area, the intermediate anchor being configured to support the diaphragm to space the diaphragm from the lower back plate, and to provide elasticity for the diaphragm, wherein the intermediate anchor has a U-shaped vertical section to be in contact with an upper surface of the lower back plate.

2. The MEMS microphone of claim 1, further comprising:

a lower anchor being in contact with an upper surface of the substrate in the supporting area, the lower anchor being configured to support the lower back plate to space the lower back plate apart from the substrate; and an upper anchor being in contact with an upper surface of the diaphragm in the supporting area, the upper anchor being configured to support the upper back plate to space the upper back plate apart from the diaphragm.

3. The MEMS microphone of claim 2, further comprising:

a lower insulation layer disposed on the upper surface of the substrate and outside of the lower anchor, and being configured to support the lower back plate;

an intermediate insulation layer disposed on an upper surface of the lower insulation layer and outside of the intermediate anchor, and being configured to support the diaphragm; and a upper insulation layer disposed on an upper surface of the intermediate insulation layer and outside of the upper anchor, and being configured to support the upper back plate.

4. The MEMS microphone of claim 3, further comprising:

a lower electrode penetrating through the upper insulation layer and the intermediate insulation layer and being disposed in the peripheral area to make electrical contact with the lower back plate;

an intermediate electrode penetrating through the upper insulation layer and being disposed in the peripheral area to make electrical contact with the diaphragm; and an upper electrode disposed in the peripheral area and making electrical contact with the upper back plate.

5. The MEMS microphone of claim 4, wherein each of the lower back plate and the upper back plate includes a conductive layer and insulation layers disposed on an upper surface and a lower surface of the conductive layer.

6. The MEMS microphone of claim 5, wherein the upper insulation layer included in the upper back plate includes a pair of protrusion portions protruding from a lower surface of the upper insulation layer and penetrating through the conductive layer to make contact with the lower insulation layer included in the upper back plate, and wherein the protrusion portions divide the conductive layer into an inner area, an intermediate area surrounding the inner area, and an outer area surrounding the intermediate area.

7. The MEMS microphone of claim 6, wherein the lower electrode makes contact with the intermediate area of the conductive layer, the intermediate electrode makes contact with the outer area of the conductive layer, and the upper electrode makes contact with the inner area of the conductive layer.

8. The MEMS microphone of claim 1, wherein the diaphragm defines a plurality of vent holes penetrating therethrough and spaced apart from each other to be arranged along a periphery of the diaphragm.

9. The MEMS microphone of claim 1, further comprising:

lower dimples protruding from a lower surface of the diaphragm toward the lower back plate and preventing the diaphragm from being coupled to the lower back plate; and upper dimples protruding from a lower surface of the upper back plate toward the diaphragm and preventing the upper back plate from being coupled to the diaphragm.

10. A method of manufacturing a MEMS microphone, comprising:

forming a lower insulation layer on a substrate, the substrate having a vibration area, a supporting area surrounding the vibration area, and a peripheral area surrounding the supporting area;

forming a lower back plate having a plurality of lower acoustic holes on the lower insulation layer;

forming an intermediate insulation layer on the lower insulation layer on which the lower back plate is formed;

forming a diaphragm and an intermediate anchor being configured to support the diaphragm on the intermediate insulation layer, respectively;

forming an upper insulation layer on the intermediate insulation layer on which the diaphragm and the intermediate anchor are formed; and forming a upper back plate having a plurality of upper acoustic holes on the upper insulation layer.

11. The method of claim 10, wherein forming the lower back plate includes forming a lower anchor being configured to support the lower back plate simultaneously, and wherein forming the upper back plate includes forming an upper anchor being configured to support the upper back plate simultaneously.

12. The method of claim 11, wherein the lower anchor, the intermediate anchor and the upper anchor are disposed in the supporting area, and wherein the lower anchor is in contact with an upper surface of the substrate, the intermediate anchor is in contact with an upper surface of the lower back plate, and the upper anchor is in contact with an upper surface of the diaphragm.

13. The method of claim 10, further comprising:

after forming the upper back plate, forming a lower electrode, an intermediate electrode, and an upper electrode in the peripheral area, and wherein the lower electrode penetrates through the upper insulation layer and the intermediate insulation layer to make electrical contact with the lower back plate, the intermediate electrode penetrates through the upper insulation layer to make electrical contact with the diaphragm, and the upper electrode makes electrical contact with the lower upper back plate.

14. The method of claim 13, wherein each of the lower back plate and the upper back plate includes a conductive layer and insulation layers disposed on an upper surface and a lower surface of the conductive layer.

15. The method of claim 14, wherein the upper insulation layer included in the upper back plate includes a pair of protrusion portions protruding from a lower surface of the upper insulation layer and penetrating through the conductive layer to make contact with the lower insulation layer included in the upper back plate, and wherein the protrusion portions divide the conductive layer into an inner area, an intermediate area surrounding the inner area, and an outer area surrounding the intermediate area.

16. The method of claim 15, wherein the lower electrode makes contact with the intermediate area of the conductive layer, the intermediate electrode makes contact with the outer area of the conductive layer, and the upper electrode makes contact with the inner area of the conductive layer.

17. The method of claim 13, further comprising:

after forming the lower electrode, the intermediate electrode, and the upper electrode, patterning the upper back plate to form upper acoustic holes penetrating the back plate;

patterning the substrate to form a cavity exposing the lower insulation layer to the vibration area; and performing an etching process using the cavity, the lower acoustic holes, and the upper acoustic holes to remove portions of the lower insulation layer and the intermediate insulation layer, located at positions corresponding the vibration area and the supporting area so that the diaphragm is bendable by acoustic pressure.

18. The method of claim 17, wherein forming the diaphragm and the intermediate anchor includes forming a plurality of vent holes penetrating through the diaphragm simultaneously with the diaphragm and the intermediate anchor, and wherein the vent holes are formed on the vibration area.

19. The method of claim 18, wherein the vent holes serve as passages for an etchant to remove the portions of the lower insulation layer and the intermediate insulation layer during the etching process.

* * * * *